US006536502B2

(12) United States Patent
Britto et al.

(10) Patent No.: US 6,536,502 B2
(45) Date of Patent: Mar. 25, 2003

(54) ADJUSTABLE WIDTH CHILD SAFETY BARRIER

(75) Inventors: James J. Britto, Westport, MA (US); Robert D. Monahan, Canton, MA (US); Thomas A. Hagerty, Somerville, MA (US); Jon R. Rossman, Chelmsford, MA (US); Bryan R. Hotaling, Arlington, MA (US)

(73) Assignee: First Years Inc., The, Lake Forest, CA (US)

( * ) Notice: Subject to any disclaimer, the term of this patent is extended or adjusted under 35 U.S.C. 154(b) by 0 days.

(21) Appl. No.: 09/874,735

(22) Filed: Jun. 5, 2001

(65) Prior Publication Data

US 2002/0179257 A1 Dec. 5, 2002

(51) Int. Cl.[7] ..... E06B 9/08

(52) U.S. Cl. ..... 160/23.1; 160/293.1; 160/294; 160/305; 242/382.4

(58) Field of Search ..... 160/23.1, 293.1, 160/290.1, 294, 295, 300–308; 49/57, 55, 463; 242/563.2, 382.4; 292/167

(56) References Cited

U.S. PATENT DOCUMENTS

| | | | | |
|---|---|---|---|---|
| 612,166 | A | | 11/1898 | Lefort |
| 708,441 | A | | 9/1902 | Williams et al. |
| 1,215,462 | A | | 2/1917 | Agee et al. |
| 1,217,210 | A | * | 2/1917 | Packer |
| 1,756,030 | A | | 4/1930 | Kownatzky |
| 1,778,404 | A | * | 10/1930 | Stone |
| 1,902,949 | A | | 3/1933 | Condon |
| 1,996,108 | A | | 4/1935 | Herr |
| 2,194,871 | A | * | 3/1940 | Pracchia |
| 2,354,169 | A | * | 7/1944 | Fredholm |
| 2,484,984 | A | | 10/1949 | Davis |
| 2,812,020 | A | * | 11/1957 | Wachtendorff |
| 3,000,063 | A | | 9/1961 | Hoog |
| 3,163,205 | A | | 12/1964 | Gootlieb |
| 3,216,482 | A | | 11/1965 | Lindholm |
| 3,965,960 | A | * | 6/1976 | Massey |
| 4,272,922 | A | | 6/1981 | Prager |
| 4,277,913 | A | | 7/1981 | Castle |
| 4,380,327 | A | | 4/1983 | Fish |
| 4,381,626 | A | | 5/1983 | Courtis et al. |
| 4,470,221 | A | | 9/1984 | Courtis |
| 4,506,477 | A | | 3/1985 | Castle |
| 4,583,715 | A | | 4/1986 | Wright |
| 4,607,455 | A | | 8/1986 | Bluem et al. |
| 4,685,247 | A | | 8/1987 | Alam |
| 4,787,174 | A | | 11/1988 | Brown |
| 4,852,194 | A | | 8/1989 | Langan |
| 5,020,834 | A | | 6/1991 | Zilkha |

(List continued on next page.)

FOREIGN PATENT DOCUMENTS

| | | | |
|---|---|---|---|
| CH | 69303 | * | 6/1915 |
| CH | 236549 | * | 7/1945 |
| DK | 4567 | | 2/1902 |
| EP | 18864 | * | 11/1980 |
| GB | 2 129 473 A | | 5/1984 |
| WO | WO 91/16519 | | 10/1991 |
| WO | WO 93/12317 | | 6/1993 |

*Primary Examiner*—Blair M. Johnson
(74) *Attorney, Agent, or Firm*—Fish & Richardson P.C.

(57) ABSTRACT

A method is disclosed of installing a barrier device at a passageway. The method includes attaching a barrier housing containing a retractable barrier to a structural element on one side of the passageway, extending the barrier a desired distance from the barrier housing, with the barrier so extended, setting an extension limit of the barrier to prevent subsequent extension of the barrier beyond the desired distance from the barrier housing and, with the extension limit set, retracting the barrier into the housing. The set extension limit can permit subsequent retraction and re-extension of the barrier up to the set extension limit.

65 Claims, 7 Drawing Sheets

U.S. PATENT DOCUMENTS 5,052,461 A 10/1991 Stern
5,090,468 A * 2/1992 Tedeschi
5,102,103 A 4/1992 Putnam
5,152,508 A 10/1992 Fish
5,168,584 A 12/1992 Peebles
5,233,710 A 8/1993 Bernard
5,271,449 A 12/1993 Herrick
5,299,782 A 4/1994 Lambert
5,437,115 A 8/1995 Freese et al.
5,437,134 A 8/1995 Donnelly
5,505,244 A 4/1996 Thumann
5,531,258 A 7/1996 Poulson et al.
5,533,715 A 7/1996 Dandrea
5,553,833 A 9/1996 Bohen
5,617,674 A 4/1997 Terrill
5,636,679 A 6/1997 Miller et al.
5,638,885 A 6/1997 Freese et al.
5,657,809 A 8/1997 Longoria et al.
5,690,317 A * 11/1997 Sandsborg
5,704,164 A 1/1998 Huang
5,709,349 A * 1/1998 De Chevron Villette et al.
5,782,039 A 7/1998 Scherer et al.
5,797,218 A 8/1998 Holland
5,829,505 A 11/1998 Brescia
5,906,068 A 5/1999 Bode
5,924,242 A 7/1999 Macari et al.
5,927,011 A 7/1999 Sickenius
5,943,832 A 8/1999 Russell
6,056,038 A 5/2000 Foster et al.
6,244,324 B1 * 6/2001 Quates et al.
2001/0015266 A1 8/2001 Yates et al.

* cited by examiner

ADJUSTABLE WIDTH CHILD SAFETY BARRIER

BACKGROUND

The invention relates to child safety barriers, such as are placed across doorways to protect children.

Safety gates are found in interior doorways in the homes of many people with infants or small children. Some such gates are rigidly mounted to one side of a passage and can swing open. Others, for example, are secured by pressure against a doorframe, and removed entirely to allow passage. Still others, for example Sandsborg, U.S. Pat. No. 5,690,317, have suggested expanding a flexible barrier across a doorway to act as a safety gate for children. Improvements in manufacturability and ease of use are desired for such gates.

SUMMARY OF THE INVENTION

The invention features a flexible barrier-type safety gate that can be readily adjusted to set a maximum extension width when mounting the gate in position.

In one broad aspect a method of installing a barrier device at a passageway is disclosed that includes attaching a barrier housing to a structural element on one side of the passageway, the barrier housing containing a retractable barrier that is extendable across the passageway, extending the barrier a desired distance from the barrier housing, with the barrier so extended, setting an extension limit of the barrier to prevent subsequent extension of the barrier beyond the desired distance from the barrier housing, the extension limit permitting subsequent retraction and re-extension of the barrier up to the set extension limit, and with the extension limit set, retracting the barrier into the housing. The method may also include attaching a receptacle housing with a receptacle capable of mating to a latching device on the barrier and re-extending the barrier to engage the latching device with the receptacle to prevent the barrier from inadvertently retracting. Setting the extension limit of the barrier can include positioning an adjustable stop so that it contacts a stop member coupled to the barrier to impede subsequent movement of the barrier stop member beyond that position. The barrier can be coupled at one edge to a shaft, and the barrier stop member can include a shaft gear secured to the shaft and coupled to a stop gear. The stop gear can be configured to rotate less than 360 degrees when the barrier is extended from a fully retracted position to a fully extended position and can be configured to rotate less than 360 degrees for each full rotation of the shaft. The stop gear may be coupled to the shaft gear through an intermediate gear, with the shaft gear and the intermediate gear defining a first reduction ratio that is between about 1:1 and 20:1, that is more preferably between about 2:1 and 7:1 and that is most preferably about 3.25:1, and the intermediate gear and the stop gear defining a second reduction ratio that is between about 1:1 and 20:1, that is more preferably between about 2:1 and 7:1 and that is most preferably about 3.25:1. The first and second reduction ratios can be combined to define a total reduction ratio that is between about 5:1 and 20:1 and that is more preferably about 10.25:1. The adjustable stop position may be adjusted by positioning might adjustment knob that is exposed for manual manipulation by an operator. The adjustment knob can be rotatable about an axis to a selectable position thereby setting a desired position of the adjustable stop.

In a second broad aspect, an adjustable width child safety device is disclosed that includes a housing mountable to a surface on one side of a passageway, a main shaft coupled to the housing for rotation about an axis, a flexible barrier secured to the main shaft at an inner edge of the barrier, the barrier being extendable across the passageway to inhibit passage by a child and an extension limiter coupling a first end of the main shaft to the housing. The extension limiter includes an adjustable stop configured to be secured to the housing in any of a multiplicity of selectable positions, and a barrier stop member coupled to the main shaft to rotate as the shaft turns. The barrier stop member is positioned to engage the adjustable stop as the barrier is extended with the adjustable stop secured in a selected position, thereby limiting further extension of the barrier from the housing, while permitting subsequent retraction and re-extension of the barrier up to an extension limit set by the selected position of the adjustable stop. The barrier stop member can include a shaft gear secured to the main shaft, and a stop gear coupled to the shaft gear. The stop gear can include a discrete stop surface defining a rotational limit of the shaft, the stop surface being positioned to engage the adjustable stop thereby impeding rotation of the stop gear with respect to the housing. The stop gear can be constructed to rotate less than 360 degrees for each full rotation of the shaft. The stop gear can be coupled to the shaft gear through an intermediate gear, the shaft gear and the intermediate gear defining a first reduction ratio, and the intermediate gear and the stop gear defining a second reduction ratio. The first and second reduction ratios combine to define a total reduction ratio that is between about 5:1 and 20:1 but is more preferably about 10.25:1. The total reduction ratio can be such that the stop gear rotates less than 360 degrees as the barrier is extended from a fully retracted position to a fully extended position. Each of the first and second reduction ratios can be between about 1:1 and 20:1 but is more preferably between about 2:1 and 7:1 and is most preferably about 3.25:1.

The adjustable stop can include an adjustment knob exposed for manual manipulation by an operator to set the adjustable stop in a desired position. The adjustment knob can be rotatable about an axis to a multiplicity of selectable positions, each selectable position corresponding to a selectable position of the adjustable stop. The adjustable width child safety device can further include a lock positioned to engage the adjustable stop and to prevent adjustment of a selected position of the adjustable stop until the lock is released.

The adjustable width child safety device can also include a spring load assembly coupling the barrier to the housing and biasing the barrier position toward a retracted position. The spring loading assembly can include a stationary shaft at least partially contained within the main shaft and securely attached to the housing. A torsion spring can be disposed between the stationary shaft and the rotatable main shaft, and can have a first end that is securely attached to the stationary shaft and a second end securely attached to the main shaft. The width of the flexible barrier, perpendicular to its direction of extension, can range from about 1 to 4 feet.

The adjustable width child safety device also can include a latch housing mountable to a surface on an opposite side of the passageway and defining a latch receptacle for receiving and releasably securing a latch assembly that is secured to an outer edge of the barrier. The latch assembly can include a latch release trigger operable to withdraw a locking tab from a slot in the latch housing and a trigger lock having an adjustable position to either enable or prevent the latch release trigger from withdrawing the locking tab from the slot in the latch housing. The latch release trigger and the trigger lock may be simultaneously operated using a single hand. Typically the barrier can extend from the housing to a distance between about 12 inches and 72 inches or more preferably between about 24 and 51 inches. The barrier can be a flexible sheet void of holes there through larger than 1 square inch in area or a mesh sheet.

In yet another broad aspect, an adjustable width child safety device is disclosed that includes a housing mountable to a surface on one side of a passageway, a main shaft having a first end and a second end, each end being coupled to the housing and allowing rotation of the main shaft about an axis, a flexible barrier secured to the main shaft at one edge of the barrier, and extendable across the passageway to inhibit passage by a child, an extension limiter coupling the first end of the main shaft to the housing, the extension limiter including a movable member with a shaft gear secured to the main shaft, an intermediate gear coupled to the shaft gear, and a stop gear coupled to the intermediate gear, the stop gear comprising a rotation limiting flag and configured to rotate less than 360° for each rotation that the main shaft makes, and a fixed member with a rotation limiting flag stop having an adjustable position, positionable to impede the motion of the stop gear, thereby, setting a rotational limit of the main shaft with respect to the housing while permitting subsequent retraction and re-extension of the barrier up to the set rotational limit. The child safety barrier also includes a rotational limit adjustment knob securely coupled to the fixed member, the rotational limit adjustment knob being rotatable about an axis to enable adjusting the position of the fixed member, the rotational limit adjustment knob being matable with a locking member. The shaft gear and the intermediate gear define a first reduction ratio and the intermediate gear and the stop gear define a second reduction ratio, the first and second reduction ratios combine to define a total reduction ratio. The total reduction ratio can be such that the stop gear rotates less than 360 degrees as the barrier is extended from a fully retracted position to a fully extended position. Each of the first and the second reduction ratios can be between approximately 1:1 and 20:1. The total reduction ratio can be between about 5:1 and 20:1.

The adjustable width child safety device also can include a stationary shaft at least partially contained within the main shaft and securely attached to the housing. A torsion spring can be disposed between the stationary shaft and the main shaft, the torsion spring having a first end securely attached to the stationary shaft and a second end securely attached to the main shaft. The adjustable width child safety device can be configured to block access through the passageway over a height that is between about 1 and 4 feet.

The adjustable width child safety device also can include a latch receptacle housing mounted to a surface on an opposite side of the passageway and defining a latch receptacle for receiving and releasably securing a latch assembly secured to an outer edge of the barrier.

Implementation of the techniques and apparatus described herein may provide one or more of the following advantages. A barrier with a set extension limit can be simply erected to prevent children from traversing a passageway. At the same time, the barrier can allow an adult to simply unlatch the barrier, retract the barrier, traverse the passageway, re-extend and relatch the barrier to the original extended position. The barrier extension limit need not be set each time the passageway is traversed.

DETAILED DESCRIPTION

Figure 1A:
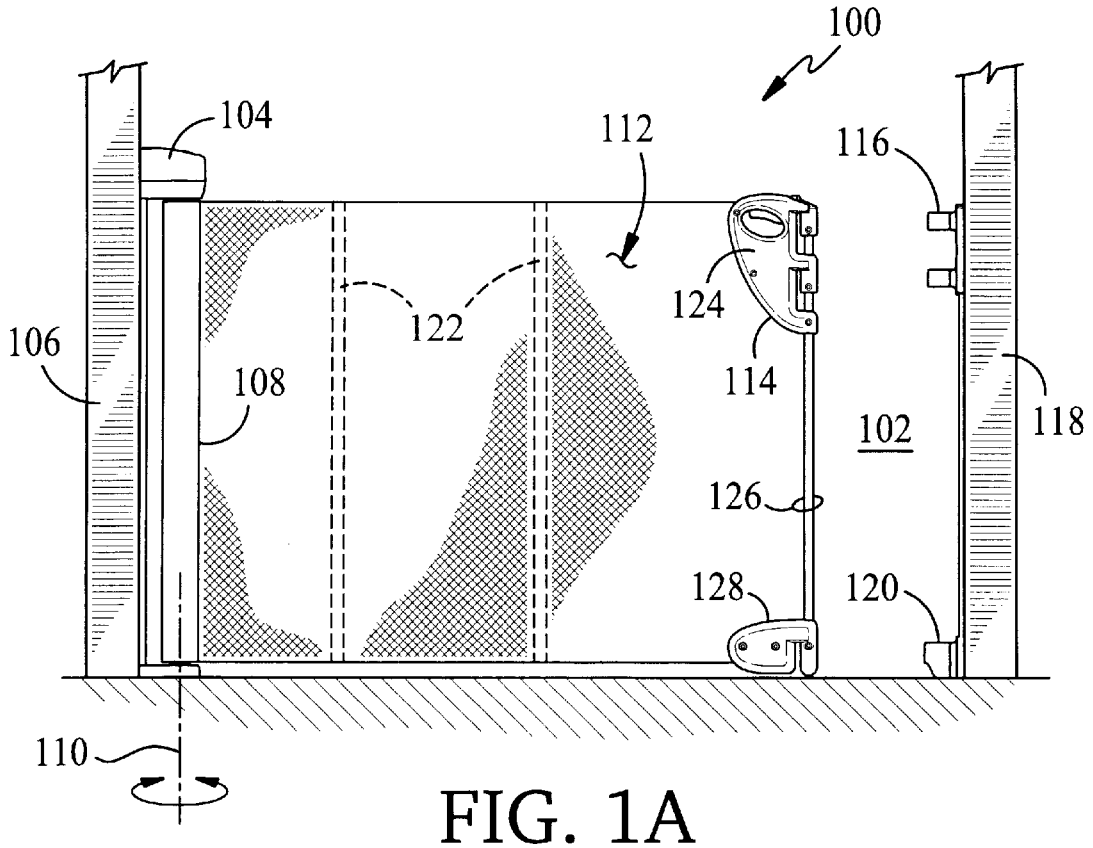
FIGS. 1A and 1B are frontal views of a child safety barrier installed at a passageway.
Figure 1B:
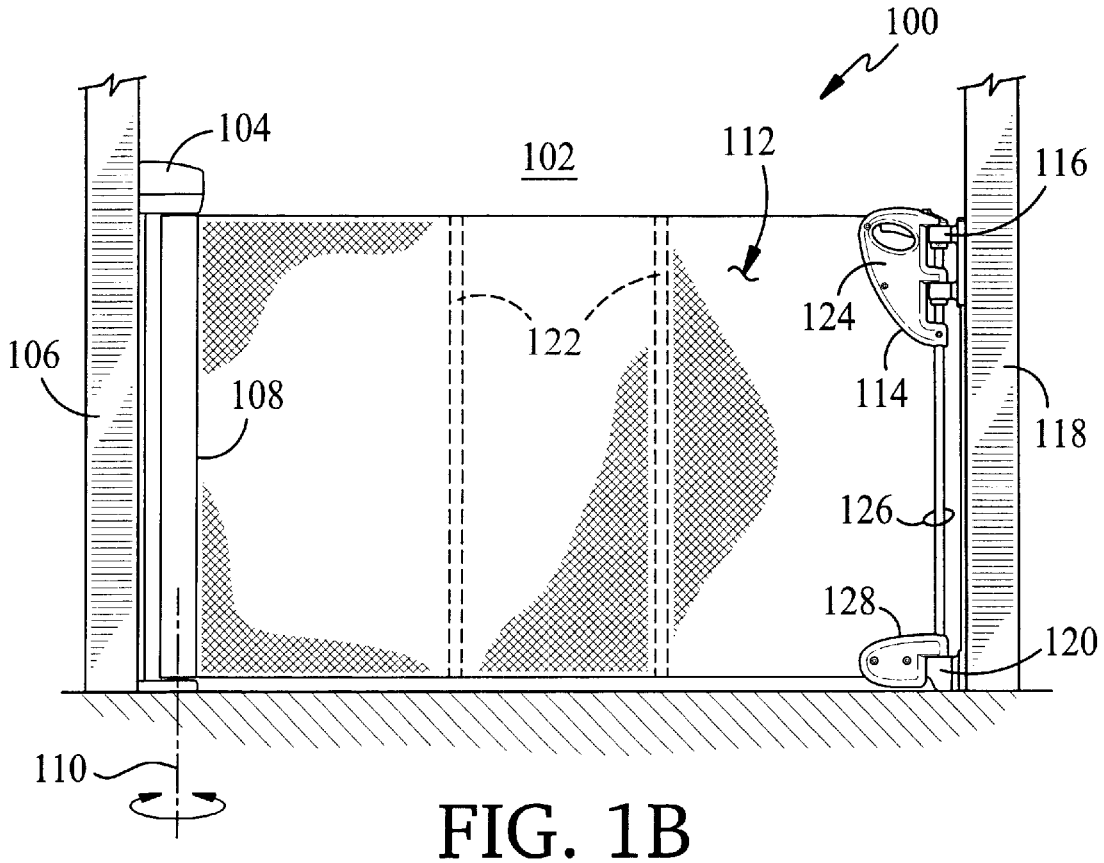

FIGS. 1A & 1B illustrate an adjustable width child safety barrier assembly 100 installed at a passageway 102. The barrier assembly 100 includes a flexible barrier 112 that can be extended across the passageway 102 to prevent the passage of a child. The barrier 112 can be, for example, a polyester mesh cloth, typically not including holes larger than approximately 1 square inch. One or more reinforcement rods 122 can be attached, for example by using heat sealing techniques, to the cloth barrier 112 thereby enhancing the structural integrity of the barrier 112. These rods 122 could be manufactured, for example, from fiberglass. The height of the barrier 112, measured in a direction perpendicular to the direction of barrier extension, can range from approximately one to four feet but is typically about 28 inches. The fully extended width of the barrier can be between approximately 12 and 72 inches or, more preferably, between approximately 24 and 51 inches.

The barrier assembly 100 includes a roller side housing 104 mounted to a structural element 106 on one side of the passageway 102. A rotatable main shaft 108 is secured to the housing 104 for rotation about an axis 110. The barrier 112 is securely attached at one edge to the main shaft 108 so that the main shaft 108 rotates as the barrier 112 is either extended or retracted. The barrier 112 includes a latching assembly 114 attached to an edge of the barrier 112 opposite the barrier's attachment to the main shaft 108. The latching assembly 114 includes an upper latching element 124, a lower latching element 128, and a rod 126 that connects the upper and lower latching elements together. With the barrier 112 extended across the width of the passageway 102, as depicted in FIG. 1B, the latching assembly 114 can be positioned to mate with an upper receptacle assembly 116 and a lower receptacle assembly 120. The upper receptacle assembly 116 and the lower receptacle assembly 120 can be connected to each other and are mounted to a structural element 118 on a side of the passageway 102 opposite the rollerside housing 104.

The barrier assembly 100 can be spring loaded so that the barrier 112 tends to automatically retract toward the housing 104 in the absence of any opposing forces.

The roller side housing 104 includes provisions that enable an operator to set a maximum extension limit for the barrier 112, thereby defining a position, beyond which the barrier 112 is prevented from extending. Typically, such an extension limit would be set with the barrier 112 initially extended to a desired position, for example, across the width of a passageway 102. The barrier assembly 100 can then be set to prevent subsequent extension of the barrier 112 beyond that set limit position, while allowing subsequent retraction and re-extension of the barrier 112 up to that limit position without requiring any further adjustments to the maximum extension limit. Alternatively, an extension limit can be set with the barrier 112 initially in a fully retracted position. In that case, when extended, the barrier 112 would be prevented from extending beyond a position defined by the set extension limit.

Figure 2:
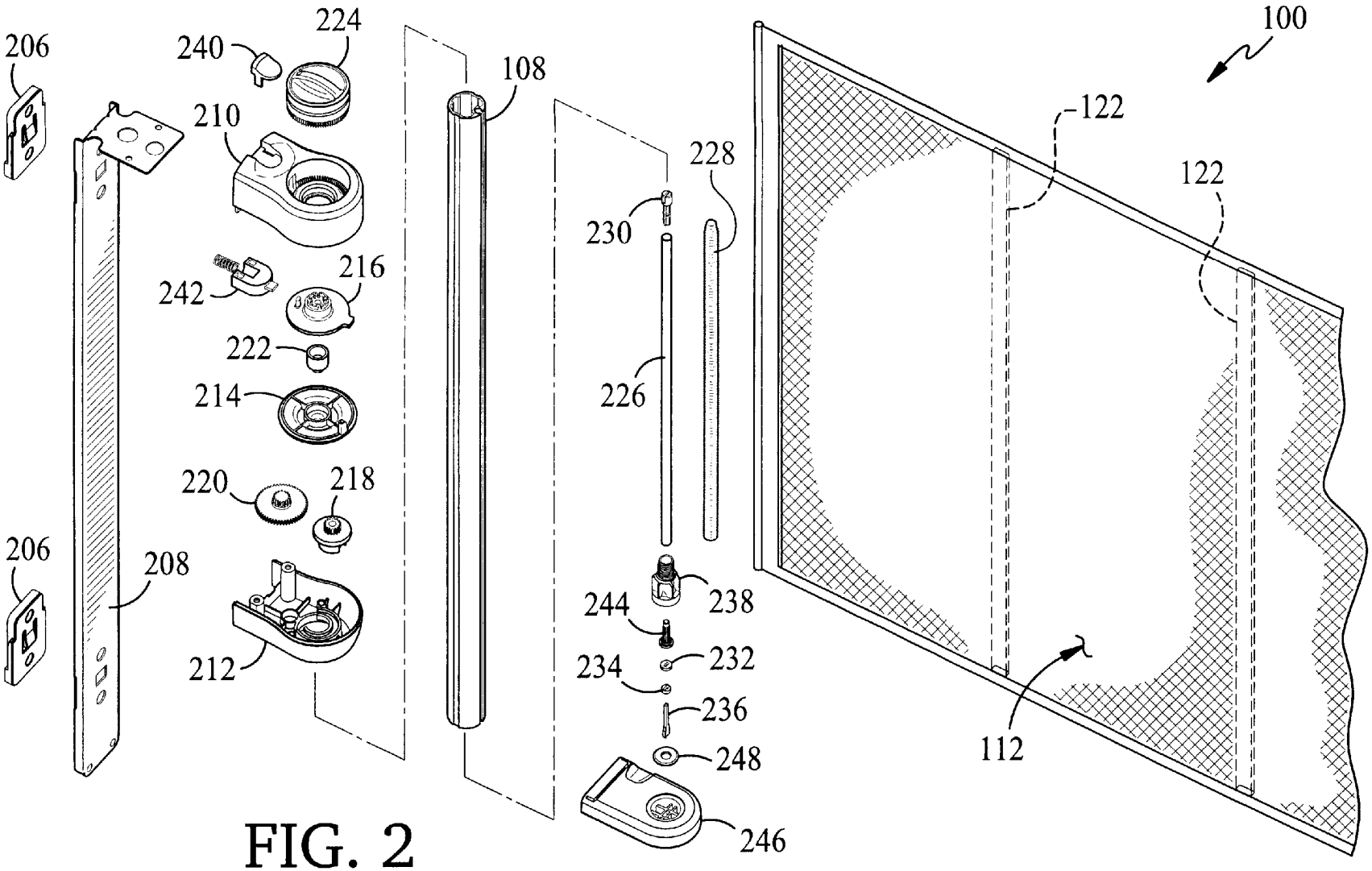
FIG. 2 is an exploded view of the housing end of the barrier.

FIG. 2 illustrates a partial exploded view of detailing particular implementation of a child safety barrier assembly 100. The components illustrated include structural elements, extension limiting elements, and retractor elements. The flexible barrier 112 also is illustrated and is connected to the main shaft 108.

The structural elements include two wall mount brackets 206 that can be securely mounted, for example, to a structural element 106 on one side of a passageway 102. A mounting rail 208 can be secured to the wall mount brackets 206 and can provide structural support for the various components coupled to it. Clips can be provided in the wall mount brackets 206 that can easily snap into apertures in the mounting rail 208 and also can easily snap out of those apertures. Such an arrangement can facilitate connecting and disconnecting the mounting rail 208 from wall mount brackets 206.

A housing 210, 212 includes an upper housing member 210 and a lower housing member 212 that can be securely attached together. The housing 210, 212 can be mounted to a horizontal portion of the mounting rail 208.

Extension limiting elements couple the upper end of the rotatable main shaft 108 to the stationary housing 210, 212 and include components that enable an operator to define an extension limit position, beyond which the barrier 112 cannot be extended, while permitting subsequent retraction and re-extension of the barrier to any position up to the set extension limit.

A rotatable stop gear 214 includes a position indicating flag that projects upward from the upper surface of the stop gear 214. The stop gear 214 is coupled to the main shaft 108 and is typically configured to rotate fewer than 360 degrees for each full rotation of the main shaft 108. The stop gear 214 also may be configured to rotate fewer than 360 degrees when the barrier 112 is extended from a fully retracted position to a fully extended position. A fixed member 216 also is illustrated and has a rotatably adjustable and lockable position. The fixed member 216 includes a limit tab projecting radially outward from its perimeter surface that is positionable to set a limit of extension for the barrier 112 with respect to the main shaft 108. The limit tab is positioned to intersect the projected path of the position indicating flag on the stop gear 214. That point of intersection defines a rotational limit position for the stop gear 214 and by extension a limit of extension for the barrier 112.

A portion of the main shaft 108 passes through the lower housing member 212 and is securely attached to a shaft gear 218. As such, the shaft gear 218 rotates about the same axis 110 as the main shaft 108, and maintains the same relative angular position as the main shaft 108. As the main shaft 108 rotates, so too does the shaft gear 218.

The shaft gear 218 includes multiple sections, and each section typically has a different outside diameter. The section of the shaft gear 218 that passes into the opening at the top of the main shaft 108 has a reduced diameter, which may be tapered or keyed to affect a secure connection between the two components. The section immediately adjacent includes a larger diameter. This step to a larger diameter prevents the shaft gear 218 from slipping into the opening in the main shaft 108. The shaft gear 218 includes a second reduced diameter section that includes gear teeth arranged around its perimeter surface. These gear teeth mesh with and can drive a complimentary set of gear teeth on an adjacent intermediate gear 220.

The intermediate gear 220 is rotatable about an axis that is parallel to the axis 110 of the main shaft 108. The intermediate gear 220 includes an upper reduced diameter section with gear teeth arranged around its perimeter surface. A boss in the lower housing member 212 passes through a bore in the intermediate gear 220 and supports the intermediate gear 220. The intermediate gear 220 typically rotates fewer degrees than the main shaft 108 does and rotates in an opposite direction from the direction that the main shaft 108 rotates. The shaft gear 218 and the intermediate gear 220 define a first reduction ratio that is typically between about 1:1 and 20:1, is more preferably between about 2:1 and 7:1 and is most preferably about 3.25:1. The gear teeth of the upper, reduced diameter section of the intermediate gear 220 mesh with and can drive a complimentary set of gear teeth on a perimeter surface of an adjacent stop gear 214. This complementary set of gear teeth on the stop gear 214 is located on a perimeter surface of a first section of the stop gear 214. Above that section, the stop gear 214 has a larger diameter section. The intermediate gear 220 and the stop gear 214 define a second reduction ratio that is typically between about 1:1 and 20:1, is more preferably between about 2:1 and 7:1 and is most preferably about 3.25:1.

The first reduction ratio and the second reduction ratio combine to define a total reduction ratio that is between about 5:1 and 20:1, but is preferably about 10.25:1. The stop gear 214 typically rotates in the same direction as the main shaft 108, but at a reduced speed. The stop gear 214 also typically rotates fewer than 360 degrees for each full rotation of the main shaft 108, and is typically configured to rotate fewer than 360 degrees as the barrier 112 is extended from a fully retracted position to a fully extended position.

A shoulder washer 222 is positioned above the stop gear 214 and can be secured, for example, by a screw to threads machined into a bore in the shaft gear 218. The shoulder washer 222 includes a first portion having a reduced outer diameter and a second portion having a larger diameter portion. The shoulder washer 222 passes through holes in the stop gear 214 and the mounting rail 208, thereby providing structural support, minimizing vertical play at the stop gear 214, and helping to maintain axial alignment at the stop gear 214 to keep it centered about its axis of rotation.

A fixed member 216 is positioned above the shoulder washer 222 so that the stop tab that extends outward from its perimeter intersects the path of travel for the stop gear 214 flag. The fixed member 216 is securely coupled to an externally accessible, adjustably positionable adjustment knob 224 that is exposed for manual manipulation by an operator to set the fixed member 216 in a desired position.

A position locking assembly 240, 242 can lock the set position of the adjustment knob 224 and the fixed member 216. The locking assembly 240, 242 includes an upper locking element 240 and a lower locking element 242. The lower locking element 242 is coupled to the housing 210, 212 and can be mated with a notch on the adjustment knob 224 to inhibit subsequent rotational movement of the adjustment knob 224 and the fixed element 216 relative to the housing 210, 212. The upper locking element 240 is externally accessible and has an adjustable position. The upper locking element 240 can be positioned relative to the lower locking element 242 in such a manner, that, adjustment of its position can impose a force on the lower locking element 242, thereby withdrawing it from the notch on the adjustment knob 224. Such a withdrawal can permit an operator to subsequently adjust the position of the adjustment knob 224 and the fixed member 216.

The retracting assembly includes a stationary shaft 226 securely coupled to the lower housing 246 through a tab bushing 244 pressed into an opening at the bottom of the stationary shaft 226, a press fit tab washer 232, a friction tab disc 234, and a spring tab 236. The spring tab 236 securely mates with both the tab bushing 244 and a recessed area of the lower housing 228, and prevents the stationary shaft from rotating relative to the lower housing 246.

The main shaft 108 is securely coupled to a shaft adapter 238 that is positioned above a bushing washer 248 within a recessed portion of the lower housing 228. The main shaft 108, shaft adapter 238 and bushing washer 248 can rotate about the same axis. The inner diameter of the bushing washer 248 is positioned to contact an outer surface of the stationary friction tab disc 234.

A spring 228 is disposed to at least partially surround the stationary shaft 226 and to pass at least partially inside the main shaft 108. The spring 228 is captured at an upper end by a plug 230, which is securely attached, for example, by press fitting to an opening at the upper end of the stationary shaft 226. The spring 228 is coupled at the opposite end to a threaded portion of the rotatable shaft adapter 238. As the barrier 112 is extended, the main shaft 108 rotates and the spring 228 tension increases, thereby biasing the barrier 112 toward a retracted position.

Figure 3:
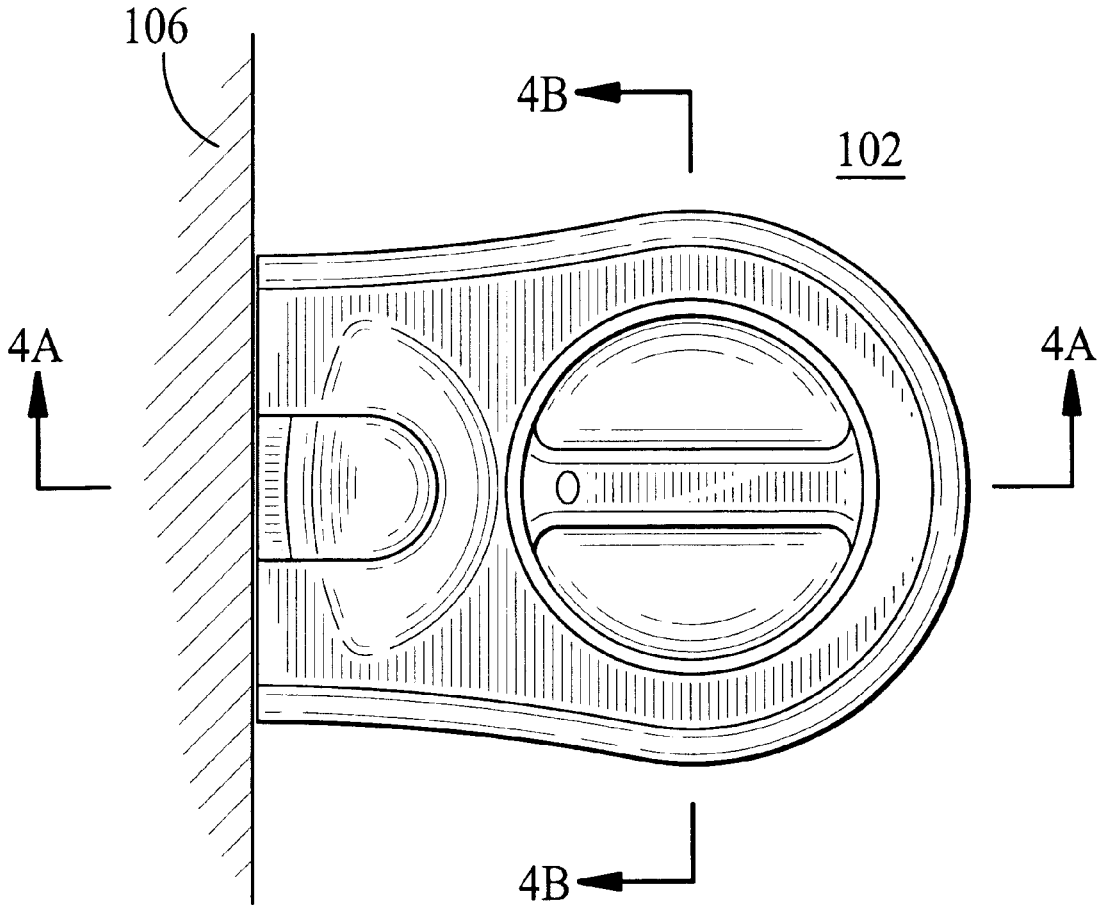
FIG. 3 is a top view of the housing end of the barrier, as mounted in a passageway.

FIG. 3 illustrates a top view of the housing end of the barrier, as mounted to a structural element 106 of a passageway 102.

Figure 4A:
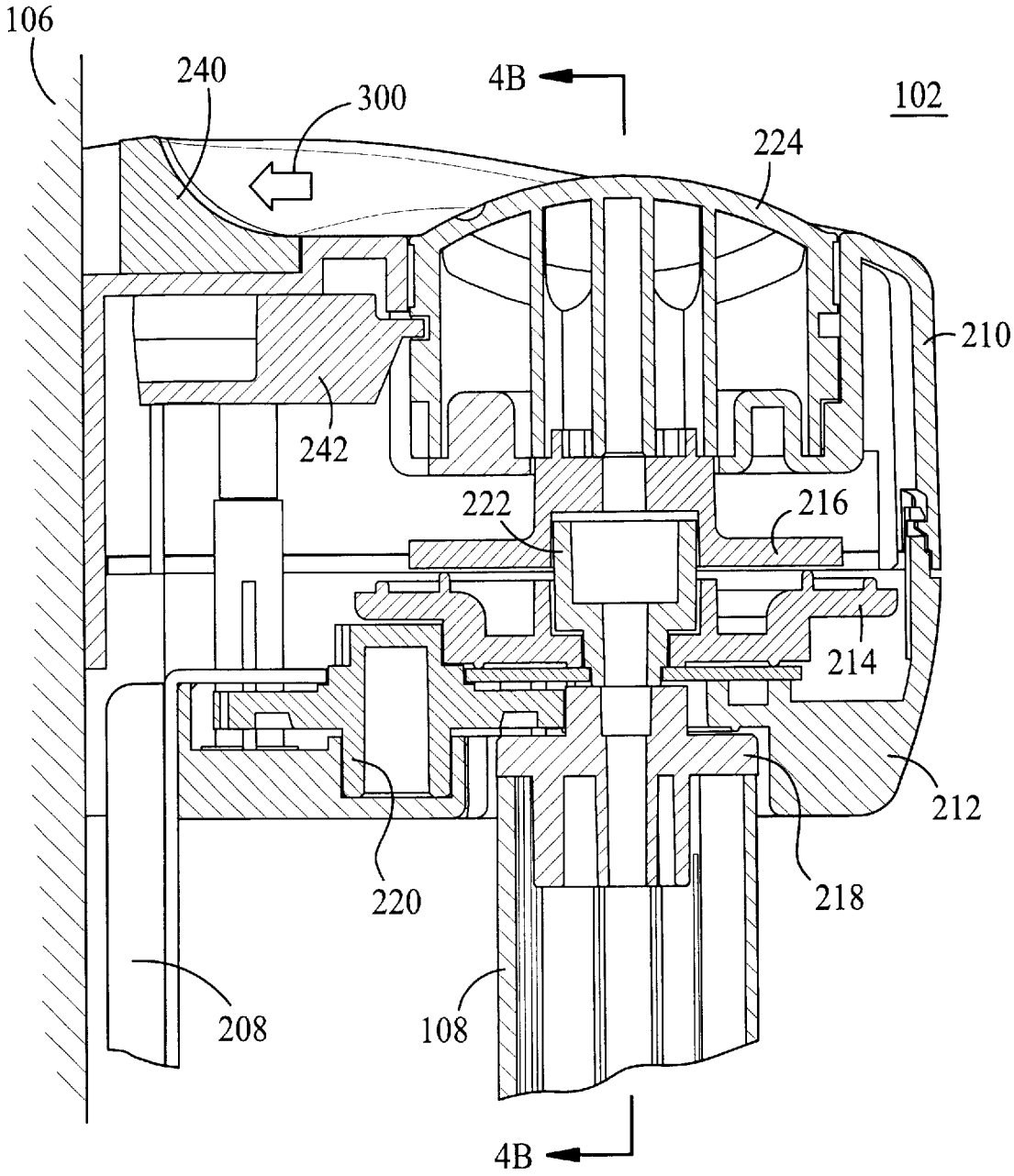
FIG. 4A is a cross-sectional view taken along line 4A—4A of FIG. 3.

FIG. 4A illustrates a cross sectional side view detailing an extension limiting assembly. As discussed above, the main shaft 108 passes through an opening in the lower housing member 212 and is securely coupled to the shaft gear 218. The upper portion of the shaft gear 218 includes gear teeth around its perimeter that mate with and drive a complimentary set of gear teeth located on the perimeter of intermediate gear 220. Intermediate gear 220 also includes an upper reduced diameter section with gear teeth around its perimeter. This second set of gear teeth on the intermediate gear 220 meshes with and drives a complimentary set of gear teeth located on a perimeter surface of stop gear 214. The stop gear 214 includes a flag (not shown) projecting upward from its upper surface.

The fixed member 216 includes a tab (not shown) projecting radially outward from its perimeter surface, positioned to intersect the path of the stop gear 214 flag. The fixed member 216 is securely coupled to the adjustment knob 224. These two components can be rotated as a single unit about an axis. By rotating these two components, an operator can adjust the position of a rotational limit of the stop gear 214 and consequently adjust the position of a rotational limit of the main shaft 108.

The assembled locking member 240, 242 is also illustrated. The lower locking element 242 is positioned to mate with a recessed portion of the adjustment knob 224 thereby preventing any rotational movement of either the adjustment knob 224 or the fixed member 216. The locking member can be removed from the recessed portion of the adjustment knob 224 by moving the upper locking element 240 in a direction identified by the arrow 300. Withdrawing the lower locking element 242 from the recessed portion of the adjustment knob 224 frees the adjustment knob 224 and the fixed member 216 to be subsequently rotated to a desired position. The bottom portion of the adjustment knob 224 may include gear teeth around its perimeter surface. These gear teeth can mesh with a complimentary set of gear teeth on the upper housing 210, effectively preventing an operator from rotating the adjustment knob 224 without lifting it thereby disengaging the mating gear teeth from each other.

Figure 4B:
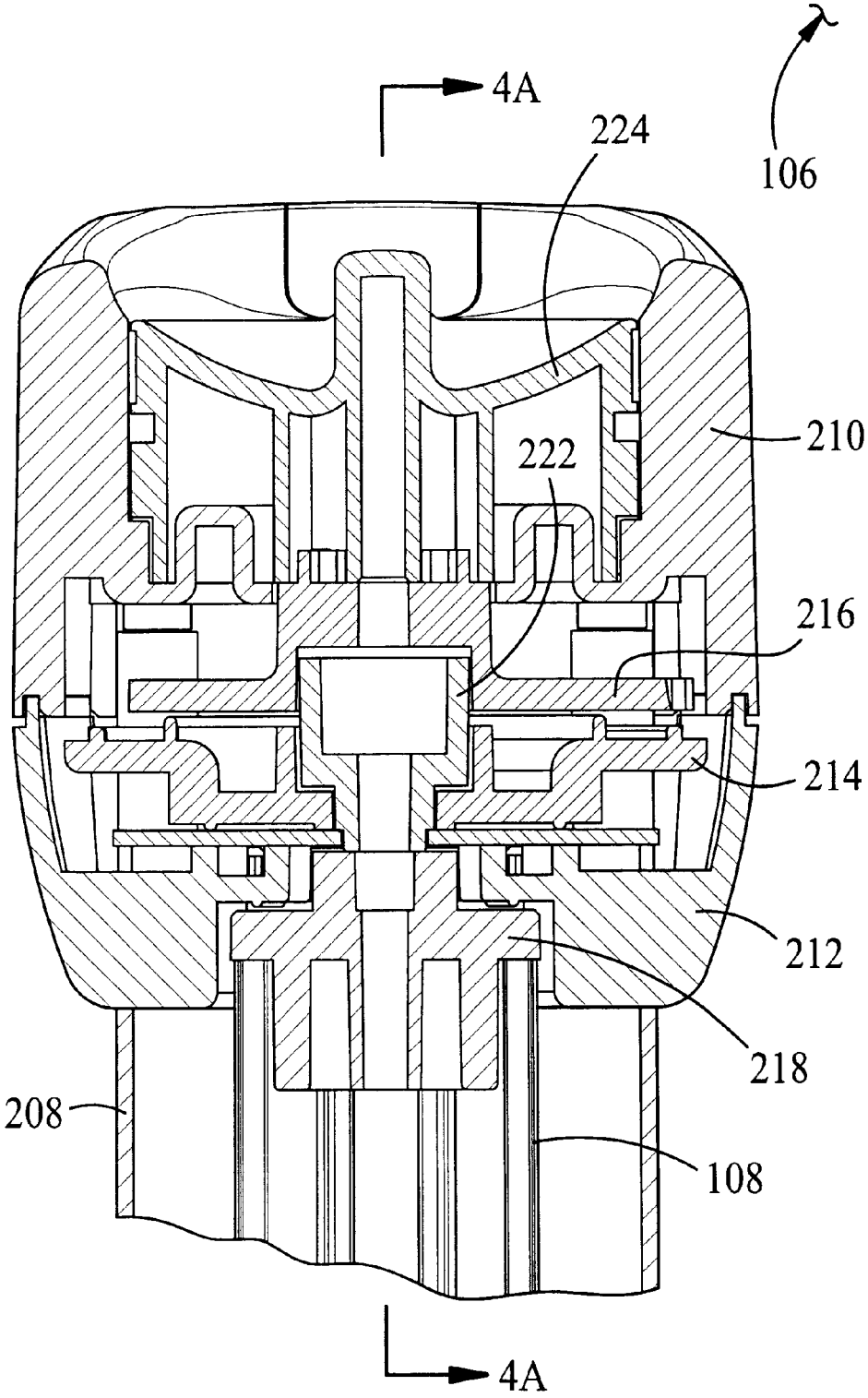
FIG. 4B is a cross-sectional view taken along line 4B—4B of FIG. 3.

FIG. 4B illustrates an alternate cut away view of the extension limiting assembly discussed above.

Figure 5:
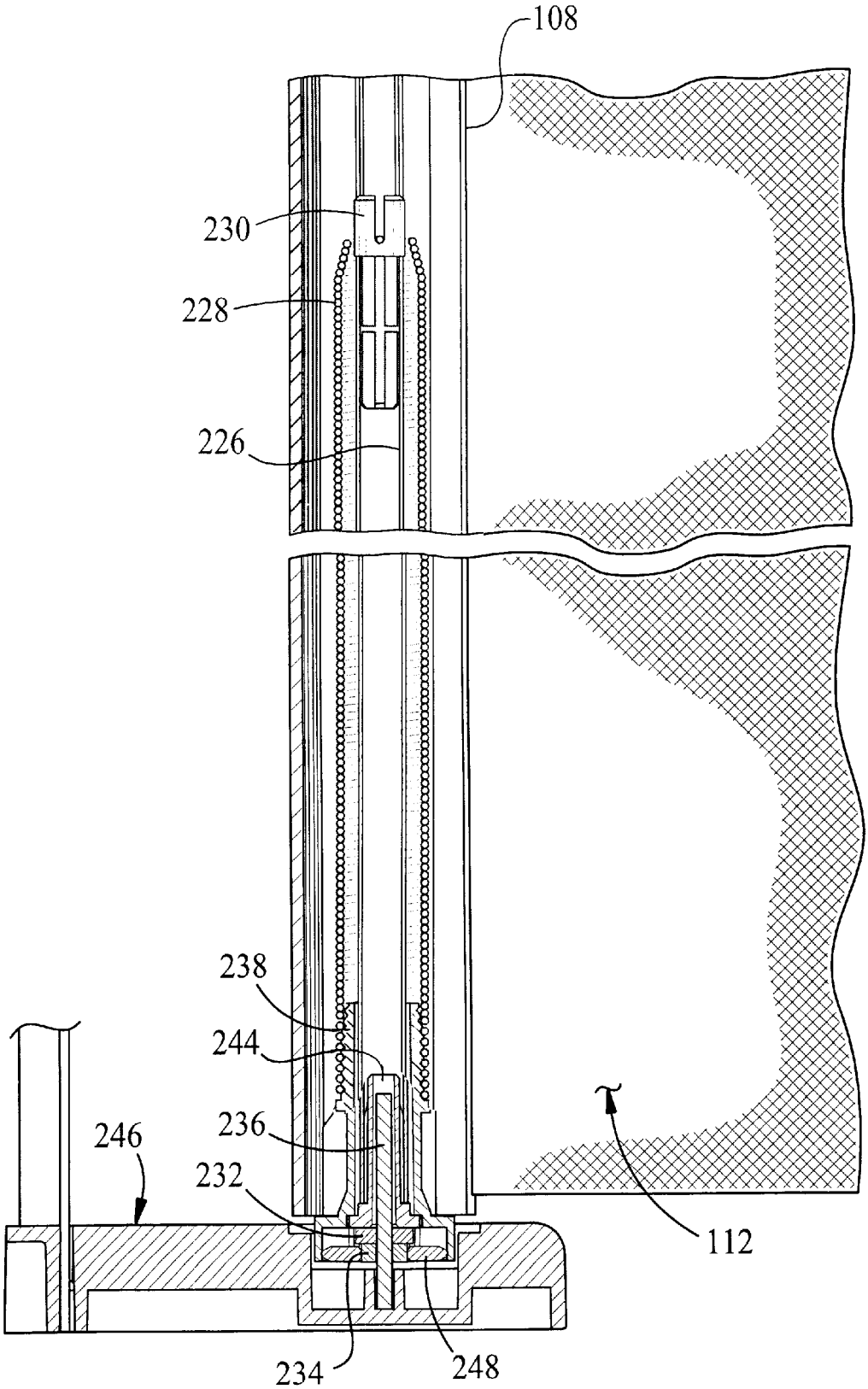
FIG. 5 is a partial cutaway view illustrating a spring load assembly.

FIG. 5 illustrates a partial sectional cutaway view of a particular implementation of a child safety barrier including a spring loaded retraction assembly. A stationary shaft 226 is positioned within the rotatable main shaft 108. The stationary shaft 226 is securely coupled to the lower housing 246. A tab bushing 244 is securely attached to the stationary shaft 226 by a press fit connection into an opening at the bottom of the stationary shaft 226. The tab bushing 244 includes an internal passage oriented axially. A spring tab 236 fits snugly into the internal passage of the tab bushing 244 and is securely attached to a recess in the lower housing 246. This spring tab 236/tab bushing 244 arrangement prevents the stationary shaft 226 from rotating with respect to the lower housing 246.

The main shaft 108 is securely coupled to a shaft adapter 238 and these two components can rotate together. A spring 228 surrounds at least a portion of the stationary shaft 226. The spring 228 is securely coupled to the upper end of the stationary shaft 226 by a plug 230 that is pressed into an opening at the upper end of the stationary shaft 226. The plug 230 remains stationary with respect to the stationary shaft 226. A first end of the spring passes through a notch at the top of the plug 230. A second end of the spring is wound onto threads around the perimeter of the shaft adapter 238. As the main shaft 108 rotates, the shaft adapter 238 also rotates. Such rotation winds the spring 228, thereby increasing the resultant spring tension. In this manner, the spring 228 can bias the barrier 112 toward a fully retracted position.

The tab bushing 244 is positioned above a stationary tab washer 232. The stationary tab washer 232 is positioned above a stationary friction tab disc 234. The outer perimeter of the stationary friction tab disc 234 provides a journal surface that the rotatable bushing washer 248 can rub against. The rotatable bushing washer 248 is press fit into the rotatable shaft adapter 238.

Figure 6A:
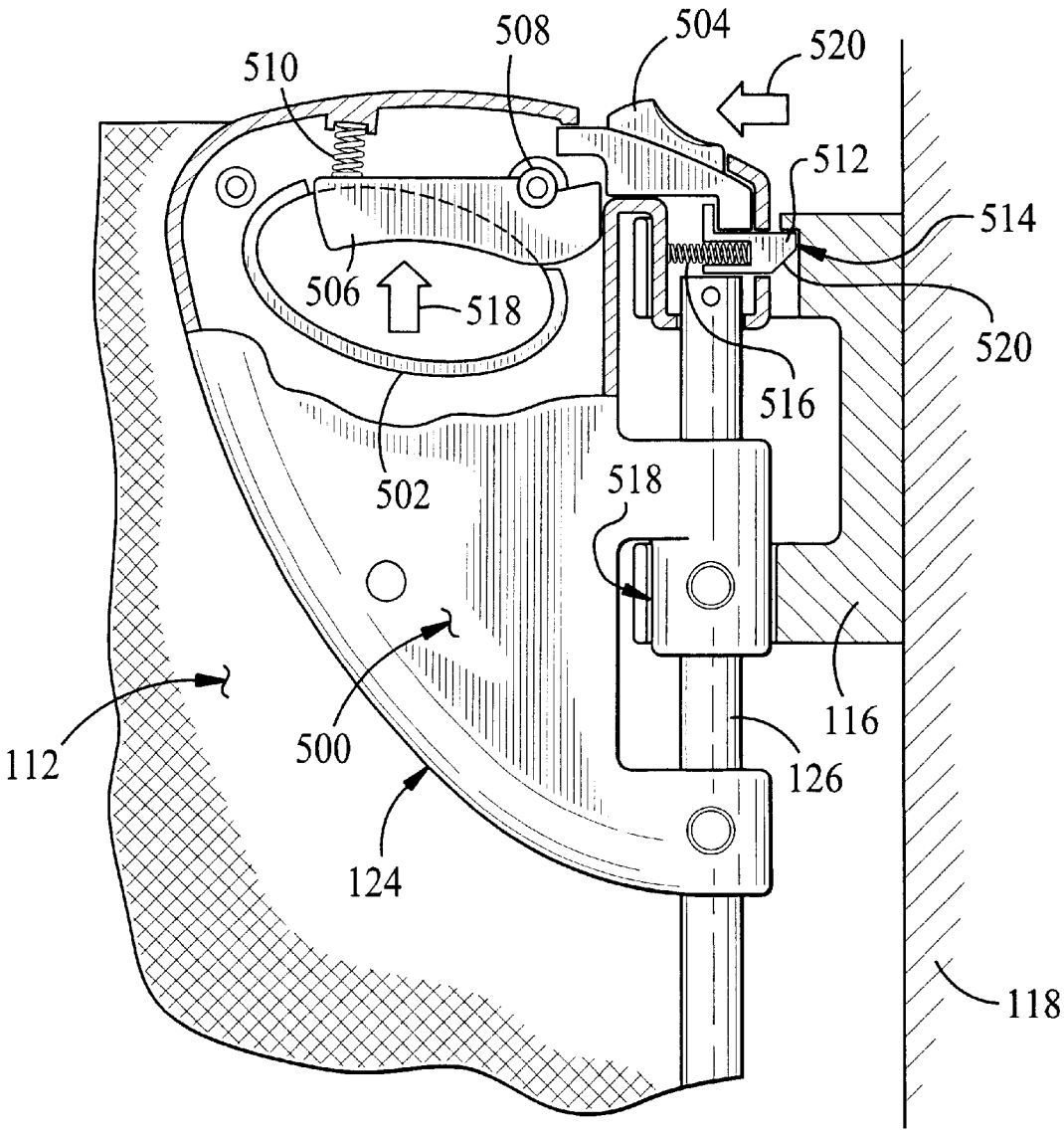
FIG. 6A is a partial cutaway view of the latching assembly.

FIG. 6A illustrates a particular embodiment of an upper latching element 124 and a wall mounted receptacle assembly 116. The upper latching element 124 includes a latch housing 500 with an externally accessible trigger lock handle 502 and an externally accessible latch release trigger 504.

The trigger lock handle 502 is securely coupled to an internal trigger lock 506. The trigger lock 506 is arranged to pivot around a pivot point 508 that is coupled to the latch housing 500. In the absence of any external forces, the trigger lock 506 is maintained in a locked position by a positioning force imposed by a trigger lock spring 510. Alternatively, a flexure, that is, an elastic plastic tab may be used to provide the positioning force in lieu of the trigger lock spring 510.

The upper latching element 124 can be prevented from disengaging from the receptacle assembly 116 by a spring-loaded latch 512 that is positionable to pass through an opening in the latch housing 500 and to be captured in a notch 514 of the receptacle assembly 116. The mating of the latch 512 and the notch 514 prevents the upper latching element 124 from being moved upward relative to the receptacle assembly 116, thereby ensuring that the upper latching element 124 cannot be inadvertently dislodged from the receptacle assembly 116. The latch 512 is biased toward a locked position, that is, a position wherein it is extended through the opening in the latch housing 500, by the latch spring 516.

The latch release trigger 504 extends into the latch housing 500 and is positionable to contact the latch 512. When the trigger lock handle 502 is moved in a direction indicated by arrow 518, the latch release trigger 504 can be then moved in a direction indicated by arrow 520 to counteract the force applied by the latch spring 516 on the latch 512. The latch 512 can be withdrawn from the notch 514 and toward the latch housing 500 eventually clearing the notch 514 and allowing the upper latch element 124 to be disengaged from the receptacle assembly 116.

The upper latching element 124 is desirably configured to enable an operator to engage and disengage it from the receptacle assembly 116 using only a single hand.

To engage the upper latching element 124 with the receptacle assembly 116, an operator would typically first position the lower latching element 128 to mate with the lower receptacle assembly 120. The operator can then position the rod 126 inside the upper receptacle assembly 116 and lower the upper latching element 124 into place. The beveled edge 520 at the bottom of the latch 512 can facilitate coupling the upper latching element 124 to the upper receptacle assembly 116.

Two sequential motions are required to disengage the upper latching element 124 from the receptacle assembly 116 as illustrated in the figure. The first motion includes moving the trigger lock handle 502 in a direction indicated by the arrow 518, thereby causing the right edge of the trigger lock 506 to move away from the latch release trigger 504. Such a motion will enable the latch release trigger 504 to be moved freely in a direction indicated by the arrow 520. The second motion includes actually moving the latch release trigger 504 in a direction indicated by the arrow 520, thereby disengaging the latch 512 from the notch 514 in the receptacle assembly 116. The upper latching element 124 can then be lifted to a position so that the rod 126 can be slipped out of the c-shaped receptacles 518 of the receptacle assembly 116.

An alternative arrangement might not include the illustrated trigger lock 506 and its associated components. Such an arrangement might allow an operator to unlatch the barrier 112 from the receptacle assembly 116 using only a single hand motion. In such a case, the force required to perform such an operation would be generally large enough to prevent an infant or small child from performing the operation. Typically such a force might be between about 12 and 15 pounds and might be implemented, for example, by an arrangement of springs or elastic members.

Figure 6B:
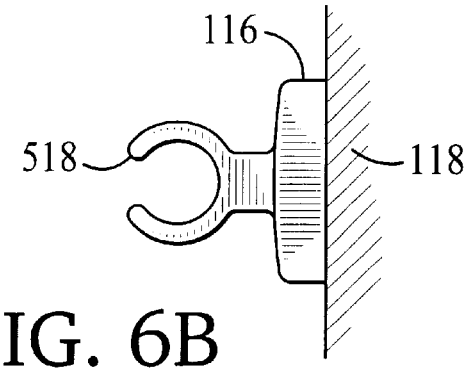
FIG. 6B is a top view of the upper latch receptacle assembly of FIG. 6A.

FIG. 6B illustrates a plan view of the upper receptacle assembly 116 having a c-shaped receptacle 518. The orientation of the c-shaped receptacle may be varied.

Various modifications to the apparatus and techniques described herein are possible. For example, the reduction ratio defined by the shaft gear, the intermediate gear, and the stop gear as specifically described herein may be implemented using an alternate gearing arrangement with either more or less reduction stages. The barrier assembly may be hand retractable and may not include provisions for spring loading the retraction feature of the barrier. The upper latching element may not include a two-step operation for disengaging it from the receptacle. Generally, if the latching mechanism is capable of being disengaged using only a single operation, the required force required to perform such an operation will be at least approximately 13 pounds to prevent a young child from being able to perform the operation.

Different techniques may be used for connecting various components to each other, such as welding, molding, using adhesives, keying or press fitting. Additionally, the general shapes and relative sizes of the different components can vary. Specific materials used also might differ depending on specific requirements of a particular application.

The apparatus and techniques described herein could be adapted for use in barriers directed to limit passage of dogs, cats, or other animals in addition to children.

Accordingly other implementations are within the scope of the following claims.

What is claimed is:

1. A method of installing a barrier device at a passageway, the method comprising:

attaching a barrier housing to a structural element on one side of the passageway, the barrier housing containing a shaft coupled at two points to the barrier housing for rotation about an axis defined by the two points, and a retractable barrier coupled to the shaft and extendable across the passageway;

extending the barrier a desired distance from the barrier housing;

with the shaft so coupled for rotation about its axis and the barrier so extended, setting an extension limit of the barrier to prevent subsequent extension of the barrier beyond the desired distance from the barrier housing, the extension limit permitting subsequent retraction and re-extension of the barrier up to the set extension limit; and with the extension limit set, retracting the barrier into the housing.

2. The method of claim 1 further comprising attaching a receptacle housing to a structural element on an opposite side of the passageway, the receptacle housing comprising a receptacle matable to a latching device on the barrier; and re-extending the barrier to engage the latching device with the receptacle to prevent the barrier from inadvertently retracting.

3. The method of claim 1 wherein setting the extension limit of the barrier comprises positioning an adjustable stop so that it contacts a barrier stop member coupled to the barrier and impedes subsequent movement of the barrier stop member beyond that position.

4. The method of claim 3 wherein the barrier is coupled at one edge to a shaft, the barrier stop member comprising a shaft gear secured to the shaft and a stop gear coupled to the shaft gear.

5. The method of claim 4 wherein the stop gear rotates about an axis less than 360 degrees as the barrier is extended from a fully retracted position to a fully extended position.

6. The method of claim 4 wherein the stop gear is configured to rotate less than 360 degrees for each full rotation of the shaft gear.

7. The method of claim 4 wherein the stop gear is coupled to the shaft gear through an intermediate gear, the shaft gear and the intermediate gear define a first reduction ratio, and the intermediate gear and the stop gear define a second reduction ratio.

8. The method of claim 7 wherein the first and second reduction ratios combine to define a total reduction ratio of between about 5:1 and 20:1.

9. The method of claim 8 wherein the total reduction ratio is about 10:1.

10. The method of claim 7 wherein each of the first and second reduction ratios is between about 1:1 and 20:1.

11. The method of claim 10 wherein each of the first and second reduction ratios is between about 5:1 and 15:1.

12. The method of claim 3 wherein positioning the adjustable stop comprises positioning an adjustment knob that is exposed for manual manipulation by an operator to set the adjustable stop to a desired position.

13. The method of claim 12 wherein positioning the adjustment knob comprises rotating the adjustment knob about an axis to a selectable position to set a desired position of the adjustable stop.

14. An adjustable width child safety device comprising:

a housing mountable to a surface on one side of a passageway;

a main shaft coupled to the housing at two points for rotation about an axis defined by the two points;

a flexible barrier secured to the main shaft at an inner edge of the barrier, the barrier being extendable across the passageway to inhibit passage by a child; and an extension limiter coupling a first end of the main shaft to the housing and accessible for manipulation by an operator with the main shaft coupled to the housing for rotation about its axis and the flexible barrier extended from the housing a selected distance, to set an extension limit of the flexible barrier, the extension limiter comprising:

an adjustable stop constructed to be secured to the housing in any of a multiplicity of selectable positions, and a barrier stop member coupled to the main shaft for motion as the shaft turns, the barrier stop member positioned to engage the adjustable stop as the barrier is extended with the adjustable stop secured in a selected position, to limit further extension of the barrier from the housing, while permitting subsequent retraction and re-extension of the barrier up to an extension limit set by the selected position of the adjustable stop.

15. The adjustable width child safety device of claim 14 wherein the barrier stop member comprises a shaft gear secured to the main shaft, and a stop gear coupled to the shaft gear.

16. The adjustable width child safety device of claim 15 wherein the stop gear comprises a discrete stop surface defining a rotational limit, the stop surface positioned to engage the adjustable stop to impede rotation of the stop gear with respect to the housing.

17. The adjustable width child safety device of claim 15 wherein the stop gear is constructed to rotate less than 360 degrees for each full rotation of the shaft gear.

18. The adjustable width child safety device of claim 15 wherein the stop gear is coupled to the shaft gear through an intermediate gear, the shaft gear and the intermediate gear defining a first reduction ratio, and the intermediate gear and the stop gear defining a second reduction ratio.

19. The adjustable width child safety device of claim 18 wherein the first and second reduction ratios combine to define a total reduction ratio that is between about 5:1 and 20:1.

20. The adjustable width child safety device of claim 19 wherein the total reduction ratio is about 10:1.

21. The adjustable width child safety device of claim 18 wherein the first and second reduction ratios combine to define a total reduction ratio that is such that the stop gear rotates less than one full revolution as the barrier is extended from a fully retracted position to a fully extended position.

22. The adjustable width child safety device of claim 18 wherein each of the first and second reduction ratios is between about 1:1 and 20:1.

23. The adjustable width child safety device of claim 18 wherein each of the first and second reduction ratios is between about 5:1 and 15:1.

24. The adjustable width child safety device of claim 14 wherein the adjustable stop includes an adjustment knob exposed for manual manipulation by an operator to set the adjustable stop in a desired position.

25. The adjustable width child safety device of claim 24 wherein the adjustment knob is rotatable about an axis to a multiplicity of selectable positions, each selectable position corresponding to a selectable position of the adjustable stop.

26. The adjustable width child safety device of claim 14 further comprising a lock positioned to engage the adjustable stop and to prevent adjustment of a selected position of the adjustable stop until the lock is released.

27. The adjustable width child safety device of claim 14 further comprising a spring loading assembly coupling the barrier to the housing and biasing the barrier position toward a retracted position.

28. The adjustable width child safety device of claim 27 wherein the spring loading assembly comprises:

a stationary shaft at least partially contained within the main shaft and securely attached to the housing; and a torsion spring disposed between the stationary shaft and the main shaft, the spring having a first end securely attached to the stationary shaft and a second end securely attached to the main shaft.

29. The adjustable width child safety device of claim 14 wherein the flexible barrier has a width, perpendicular to its direction of extension, of between about 1 and 4 feet.

30. The adjustable width child safety device of claim 14 further comprising:

a latch housing mountable to a surface on an opposite side of the passageway and defining a latch receptacle for receiving and releasably securing a latch assembly secured to an outer edge of the barrier.

31. The adjustable width child safety device of claim 30 wherein the latch assembly comprises:

a latch release trigger operable to withdraw a locking tab from a slot in the latch housing; and a trigger lock, selectively movable between a locked position in which the trigger lock prevents the latch release trigger from withdrawing the locking tab from the slot in the latch housing, and an unlocked position in which the trigger lock permits the latch release trigger to withdraw the locking tab from the slot in the latch housing.

32. The adjustable width child safety device of claim 31 wherein the latch release trigger and the trigger lock can be simultaneously operated using a single hand.

33. The adjustable width child safety device of claim 14 wherein the barrier is extendable from the housing to a fully extended position a distance between about 12 inches and 72 inches.

34. The adjustable width child safety device of claim 33 wherein the barrier is extendable from the housing to a fully extended position a distance between about 20 inches and 40 inches.

35. The adjustable width child safety device of claim 14 wherein the barrier comprises a sheet void of holes there through larger than 1 square inch in area.

36. The adjustable width child safety device of claim 14 wherein the barrier comprises a mesh sheet.

37. An adjustable width child safety device comprising:

a housing mountable to a surface on one side of a passageway;

a main shaft having a first end and a second end, each end being coupled to the housing and allowing rotation of the main shaft about an axis;

a flexible barrier secured to the main shaft at one edge of the barrier, and extendable across the passageway to inhibit passage by a child;

an extension limiter coupling the first end of the main shaft to the housing, the extension limiter comprising:

a movable member with a shaft gear secured to the main shaft, an intermediate gear coupled to the shaft gear, and a stop gear coupled to the intermediate gear, the stop gear comprising a rotation limiting flag and configured to rotate less than 360 degrees for each full revolution of the main shaft; and a fixed member comprising a rotation limiting flag stop positioned to engage and impede motion of the rotation limiting flag of the stop gear, the flag stop being adjustable to set a rotational limit of the main shaft with respect to the housing while permitting subsequent retraction and re-extension of the barrier up to the set rotational limit, and a rotational limit adjustment knob securely coupled to the fixed member, the rotational limit adjustment knob being rotatable about an axis to adjust the position of the flag stop of the fixed member.

38. The adjustable width child safety device of claim 37 wherein the shaft gear and the intermediate gear define a first reduction ratio and the intermediate gear and the stop gear define a second reduction ratio, the first and second reduction ratios combine to define a total reduction ratio, and the total reduction ratio is such that the stop gear rotates less than 360 degrees as the barrier is extended from a fully retracted position to a fully extended position.

39. The adjustable width child safety device of claim 38 wherein each of the first and the second reduction ratios are between approximately 1:1 and 20:1.

40. The adjustable width child safety device of claim 38 wherein the total reduction ratio is between about 5:1 and 20:1.

41. The adjustable width child safety device of claim 37 further comprising:

a stationary shaft at least partially contained within the main shaft and securely attached to the housing; and a torsion spring disposed between the stationary shaft and the main shaft, the spring having a first end securely attached to the stationary shaft and a second end securely attached to the main shaft.

42. The adjustable width child safety device of claim 37 configured to block access through the passageway over a height of between about 1 and 4 feet.

43. The adjustable width child safety device of claim 37 further comprising:

a latch receptacle housing mountable to a surface on an opposite side of the passageway and defining a latch receptacle for receiving and releasably securing a latch assembly of an outer edge of the barrier.

44. An adjustable width child safety device comprising:

a housing mountable to a surface on one side of a passageway;

a main shaft coupled to the housing for rotation about an axis;

a flexible barrier secured to the main shaft at an inner edge of the barrier, the barrier being extendable across the passageway to inhibit passage by a child; and an extension limiter coupling a first end of the main shaft to the housing, the extension limiter comprising:

an adjustable stop constructed to be secured to the housing in any of a multiplicity of selectable positions, and a barrier stop member comprising a shaft gear secured to the main shaft, and a stop gear coupled to the shaft gear, the barrier stop member coupled to the main shaft for motion as the shaft turns, the barrier stop member positioned to engage the adjustable stop as the barrier is extended with the adjustable stop secured in a selected position, to limit further extension of the barrier from the housing, while permitting subsequent retraction and re-extension of the barrier up to an extension limit set by the selected position of the adjustable stop.

45. The adjustable width child safety device of claim 44 wherein the stop gear comprises a discrete stop surface defining a rotational limit, the stop surface positioned to engage the adjustable stop to impede rotation of the stop gear with respect to the housing.

46. The adjustable width child safety device of claim 44 wherein the stop gear is constructed to rotate less than 360 degrees for each full rotation of the shaft gear.

47. The adjustable width child safety device of claim 44 wherein the stop gear is coupled to the shaft gear through an intermediate gear, the shaft gear and the intermediate gear defining a first reduction ratio, and the intermediate gear and the stop gear defining a second reduction ratio.

48. The adjustable width child safety device of claim 47 wherein the first and second reduction ratios combine to define a total reduction ratio that is between about 5:1 and 20:1.

49. The adjustable width child safety device of claim 48 wherein the total reduction ratio is about 10:1.

50. The adjustable width child safety device of claim 47 wherein the first and second reduction ratios combine to define a total reduction ratio that is such that the stop gear rotates less than one full revolution as the barrier is extended from a fully retracted position to a fully extended position.

51. The adjustable width child safety device of claim 47 wherein each of the first and second reduction ratios is between about 1:1 and 20:1.

52. The adjustable width child safety device of claim 47 wherein each of the first and second reduction ratios is between about 5:1 and 15:1.

53. The adjustable width child safety device of claim 44 wherein the adjustable stop comprises an exposed portion for manual manipulation by an operator to set the adjustable stop in a desired position.

54. The adjustable width child safety device of claim 53 wherein the exposed portion is rotatable about an axis to a multiplicity of selectable positions, each selectable position corresponding to a selectable position of the adjustable stop.

55. The adjustable width child safety device of claim 44 further comprising a lock positioned to engage the adjustable stop and to prevent adjustment of a selected position of the adjustable stop until the lock is released.

56. The adjustable width child safety device of claim 44 further comprising a spring loading assembly coupling the barrier to the housing and biasing the barrier position toward a retracted position.

57. The adjustable width child safety device of claim 56 wherein the spring loading assembly comprises:

a stationary shaft at least partially contained within the main shaft and securely attached to the housing; and a torsion spring disposed between the stationary shaft and the main shaft, the spring having a first end securely attached to the stationary shaft and a second end securely attached to the main shaft.

58. The adjustable width child safety device of claim 44 wherein the flexible barrier has a width, perpendicular to its direction of extension, of between about 1 and 4 feet.

59. The adjustable width child safety device of claim 44 further comprising;

a latch housing mountable to a surface on an opposite side of the passageway and defining a latch receptacle for receiving and releasably securing a latch assembly secured to an outer edge of the barrier.

60. The adjustable width child safety device of claim 59 wherein the latch assembly comprises:

a latch release trigger operable to withdraw a locking tab from a slot in the latch housing; and a trigger lock, selectively movable between a locked position in which the trigger lock prevents the latch release trigger from withdrawing the locking tab from the slot in the latch housing and an unlocked position in which the trigger lock permits the latch release trigger to withdraw the locking tab from the slot in the latch housing.

61. The adjustable width child safety device of claim 60 wherein the latch release trigger and the trigger lock can be simultaneously operated using a single hand.

62. The adjustable width child safety device of claim 44 wherein the barrier is extendable from the housing to a fully extended position a distance between about 12 inches and 72 inches.

63. The adjustable width child safety device of claim 44 wherein the barrier is extendable from the housing to a fully extended position a distance between about 20 inches and 40 inches.

64. The adjustable width child safety device of claim 44 wherein the barrier comprises a sheet void of holes there through larger than 1 square inch in area.

65. The adjustable width child safety device of claim 44 wherein the barrier comprises a mesh sheet.

* * * * *